US008316680B2

(12) United States Patent
Kümmerling et al.

(10) Patent No.: US 8,316,680 B2
(45) Date of Patent: Nov. 27, 2012

(54) METHOD OF MAKING A SEAMLESS HOLLOW BODY FROM STEEL

(75) Inventors: Rolf Kümmerling, Duisburg (DE); Gunther Manig, Peritz (DE)

(73) Assignee: V&M Deutschland GmbH, Düsseldorf (DE)

( * ) Notice: Subject to any disclaimer, the term of this patent is extended or adjusted under 35 U.S.C. 154(b) by 1096 days.

(21) Appl. No.: 11/917,843

(22) PCT Filed: Jun. 15, 2006

(86) PCT No.: PCT/DE2006/001074

§ 371 (c)(1),
(2), (4) Date: Jul. 10, 2008

(87) PCT Pub. No.: WO2006/133696

PCT Pub. Date: Dec. 21, 2006

(65) Prior Publication Data

US 2009/0113970 A1 May 7, 2009

(30) Foreign Application Priority Data

Jun. 16, 2005 (DE) ..... 10 2005 028 667

(51) Int. Cl.
*B21B 19/04* (2006.01)
*B21D 17/04* (2006.01)

(52) U.S. Cl. ..... 72/97; 72/370.01

(58) Field of Classification Search ..... 72/95–97, 72/366.2, 370.1, 371.13, 370.25, 208, 209, 72/365.2, 367.1, 368
See application file for complete search history.

(56) References Cited

U.S. PATENT DOCUMENTS

| | | | | |
|---|---|---|---|---|
| 2,274,581 | A * | 2/1942 | Bannister et al. | 72/97 |
| 3,719,066 | A * | 3/1973 | Okamoto et al. | 72/97 |
| 6,089,066 | A * | 7/2000 | Cernuschi et al. | 72/97 |
| 2006/0065032 | A1 * | 3/2006 | Yamakawa et al. | 72/97 |

FOREIGN PATENT DOCUMENTS

| | | |
|---|---|---|
| DE | 33 26946 C1 | 3/1985 |
| EP | 1 388 378 A1 | 2/2004 |
| JP | 59054404 | 3/1984 |
| JP | 01031505 | 2/1989 |

OTHER PUBLICATIONS

Karl-Heinz Brensing: "Wahl der Umformbedingungen und Gestaltung der Werkzeuge beim Schrägwalzen", in: BÄnder, Bleche, Rohre 6, No. 4, 1965, pp. 184-189.

* cited by examiner

*Primary Examiner* — Debra Sullivan
(74) *Attorney, Agent, or Firm* — Henry M. Feiereisen, LLC

(57) ABSTRACT

The invention relates to an apparatus for making a seamless hollow body (10) from a solid round block (7) of steel with a diameter <95% of the diameter of the solid round block by means of a two-roll cross-rolling mill with a piercing mandrel (3) held between the inclined roll (1) and including a piercer (5) and at least one smoothing part (4) using pass-closing guides, or by means of a three-roll cross rolling mill with a piercing mandrel held between the inclined rolls and including a piercer and at least one smoothing part, wherein the distance of the rolls is adjusted in a particular manner at the narrowest cross-section (2) in relation to the diameter of the used round block, and the position of the piercing mandrel is adjusted in relation to the narrowest cross-section of the rollers.

15 Claims, 4 Drawing Sheets

METHOD OF MAKING A SEAMLESS HOLLOW BODY FROM STEEL

BACKGROUND OF THE INVENTION

The invention relates to a method of making a seamless hollow body from steel.

The manufacture of a seamless hollow body from a solid round block of steel by means of cross rolling typically involves a piercing mandrel which is held between the inclined rolls to so adjust the round block that the distance between the rolls is smaller in the narrowest cross section by 10-12% than the diameter of the used round block.

The piercing mandrel is positioned with its piercer upstream of the narrowest cross section of the rolls. This plane is also called 'high point'.

The tip of the piercing mandrel is thus positioned before the plane of the smallest roll distance (plane "high point") such that the produced hollow block is free of any internal flaws. The smoothing part and the expansion part of the piercing mandrel (if present) are located behind of the 'high point'. More details are described in "Bänder, Bleche, Rohre 6" [*Strips, Metal Sheets, Tubes* 6], (1965) No. 4, pp. 184-189.

According to this known process, the hollow block diameters range between 5% smaller and significantly greater (≧20%) than the diameter of the used solid round block.

The known process is unsuitable to provide a greatly reducing piercing with the hollow block being free of flaws. Internal flaws are encountered in particular when extruded round blocks are involved.

SUMMARY OF THE INVENTION

It is an object of the invention to provide a method of making a seamless hollow body from a solid round block of steel by means of cross rolling, by which extruded round blocks can be pierced also with a diameter reduction of >5%, without any internal flaws.

According to one aspect of the present invention, this object is solved by a method for making a seamless hollow body from a solid round block of steel with a diameter <95% of the solid round block diameter, by means of a two-roll cross rolling mill with a piercing mandrel held between the inclined rolls and including a piercer and at least one smoothing part, while using pass-closing guides, wherein the distance of the rolls in the narrowest cross section is adjusted in the relation to the diameter of the used round block, and the position of the piercing mandrel is adjusted in relation to the narrowest cross section of the rolls, wherein the incoming solid round block maintains in front of the tip of the piercing mandrel a forming limit X which is dependent on the deformability of the used steel, on the adjusted transport angle as well as on the run-in angle of the rolls, and the tool distances are determined in good approximation (<3%) on the basis of the equations $$\text{Roll distance} = \text{diameter hollow block} - 0.075 \times \text{diameter round block}$$

$$\text{Guide distance} = \text{diameter hollow block} + 0.075 \times \text{diameter round block}$$

wherein the forming limit X is defined as (1−roll distance at the position mandrel tip to diameter of the round block) in %.

According to another aspect of the present invention, this object is solved by a method for making a seamless hollow body from solid round block of steel with a diameter <95% of the solid round block diameter, by means of a three-roll cross rolling mill with a piercing mandrel held between the inclined rolls and including a piercer and at least one smoothing part, while using pass-closing guides, wherein the distance of the rolls in the narrowest cross section is adjusted in the relation to the diameter of the used round block, and the position of the piercing mandrel is adjusted in relation to the narrowest cross section of the rolls, wherein the incoming solid round block maintains in front of the tip of the piercing mandrel a forming limit X which is dependent on the deformability of the used steel, on the adjusted transport angle as well as on the run-in angle of the rolls, and the tool distances are determined in good approximation (<3%) on the basis of the equation $$\text{Roll distance} = 3/2 \times \text{diameter hollow block} - \tfrac{1}{2} \times \text{diameter round block}$$

wherein the forming limit X is defined as (1−roll distance at the position mandrel tip to diameter of the round block) in %.

According to the teaching of the invention, the extent of the constriction (ratio roll distance to block diameter cold) is not the crucial factor for realizing a piercing that is free of internal flaws; rather it is maintaining a material-dependent and rolling-mill-dependent deformation anteriorly of the mandrel tip. The variables of block and hollow block diameters provide the basis for calculating the guide and/or roll distance according to the given equations. As a result, the position of the mandrel tip is determined with the aid of the deformation limit to be observed anteriorly of the mandrel tip.

Tests have shown that the forming limit X rises as the transport angle increases and the run-in angle decreases. The material dependency is governed by the deformability of the used steel. When simple carbon steels are involved, the forming limit X is greater in comparison to a 13% chrome steel that is hard to shape.

It has been further shown that the ascertained forming limit must be corrected with a correction factor in dependence of the cone angle, with the cone angle being defined as the angle between rolling stock and rolling axis, when the transport angle is zero degree.

When the cone angle is zero degree (barrel piercer), the correction factor is equal 1 and increases above 1 up to a value <1.3, as the positive cone angle (cone piercer) increases.

When using a three-roll cross rolling mill, the same dependencies hold true, as described above, with the difference residing only in the increase of the forming limit X by at least the factor 1.2 in comparison to a two-roll cross rolling mill.

The configuration of the tools is now a compromise between roll run-in length, roll run-in angle, mandrel length and position of the mandrel tip with consideration of the marginal production parameters.

On one hand, it must be taken into account that the smoothing part of the piercing mandrel has to commence directly at the 'high point' or even in the run-in portion of the inclined roll. On the other hand, a selected roll pass should permit, if possible, the whole range of required shaping because an exchange of inclined rolls is time consuming.

The process according to the invention closes the gap between the currently employed procedure and the process protected in DE 33 269 46 C1 and is applicable for a two-roll cross rolling mill as well as for a three-roll cross rolling mill without guides. DE 332 69 46 C1 discloses for the manufacture of in particular thin-walled hollow bodies without internal flaws and little eccentricity an adjustment of the inclined rolls to a distance in the range of 75 to 60% and an adjustment of the guides to a distance in the range of 85 to 70% of the diameter of the used round block.

The equations for calculating the roll and guide distances are as follows:

Two-roll cross rolling mill:

Roll distance = diameter hollow block − 0.075 × block diameter

Guide distance = diameter hollow block + 0.075 × block diameter

Three-roll cross rolling mill:

Roll distance = 3/2 × diameter hollow block − 1/2 × block diameter

As the individual cross rolling mill types and the material to be pierced differ in their flow behavior, the afore-mentioned equations are adequate to be able to check the possibilities to manufacture desired hollow blocks and to configure rolls and the piercing mandrel with good approximation. Good approximation relates hereby to a deviation of <3% of the hollow block diameter.

It is essential that fine tuning permits a change in roll and guide distances as well as piercing mandrel shape, while preventing at the same time that the mandrel tip does not exceed the critical decrease. The forming limit X anteriorly of the mandrel tip is defined as $$X = \left(1 - \frac{\text{Roll distance} \tan d(PositionMandrelTip)}{DiameterRoundBlock}\right)\%$$

As already stated, the permitted variable X depends on the rolling mill and the material to be pierced. It is recommended to select this variable such that all materials are pierced with the same variable.

The advantage of the proposed method for rolling mills that predominantly produce seamless tubes of up to 200 mm diameter resides in that formats that can be extruded can be used as starting material. Normally, the same roll pass allows piercing from greatly reduced to slightly expanding. As a result, the number of the required round block formats can be significantly reduced.

In this manner, a hollow block with a diameter of 186 mm may, for example, be manufactured from a round block of 220 mm diameter. Normally, this would have required a round block with 180 mm diameter and a slight widening thereof. Or, a hollow block could have only been produced from a round block of 220 mm diameter with slight reduction.

BRIEF DESCRIPTION OF THE DRAWING

An example for the determination of the roll and guide distances while maintaining a particular forming limit X will now be described, with reference to the drawing, in which.

DETAILED DESCRIPTION OF PREFERRED EMBODIMENTS

A hollow block having the dimensions 186×20 mm should be produced from a round block of a grade of steel ST 52 with a diameter of 220 mm, using a two-roll cross rolling mill. The ratio of hollow block diameter to round block diameter establishes a value of $$\frac{186}{220} = 0.84,$$

which, as stated, is far below the currently typical value of a minimum of 0.95. The two-roll cross rolling mill uses in this example a barrel piercer with side guards.

As outlined above, this means that the correction factor is equal 1. The transport angle is 10° and the run-in and run-out angles are at 3.5°. This results in a forming limit value X of 6%. As the diameter of the round block is 220 mm, a roll distance is realized at the position of the mandrel tip of 206.8 mm.

The roll distance in the 'high point' is 186 mm−0.075×220=169.5 mm, and the guide distance is 186 mm+0.075×220=202.5.

The apparatus according to the invention will be described with reference to a schematic length section. The present half-side length section shows only the upper double-conical inclined roll 1 of the cross rolling mill. The pertaining second inclined roll as well as the pass-closing guides, be it side guards or Diescher disks, that are situated in the other plane of the two-roll cross rolling mill have been omitted for the sake of simplicity.

The plane of the narrowest cross section 2 of the inclined rolls, designated as "high point", is characterized by a dashed line.

Figure 1:
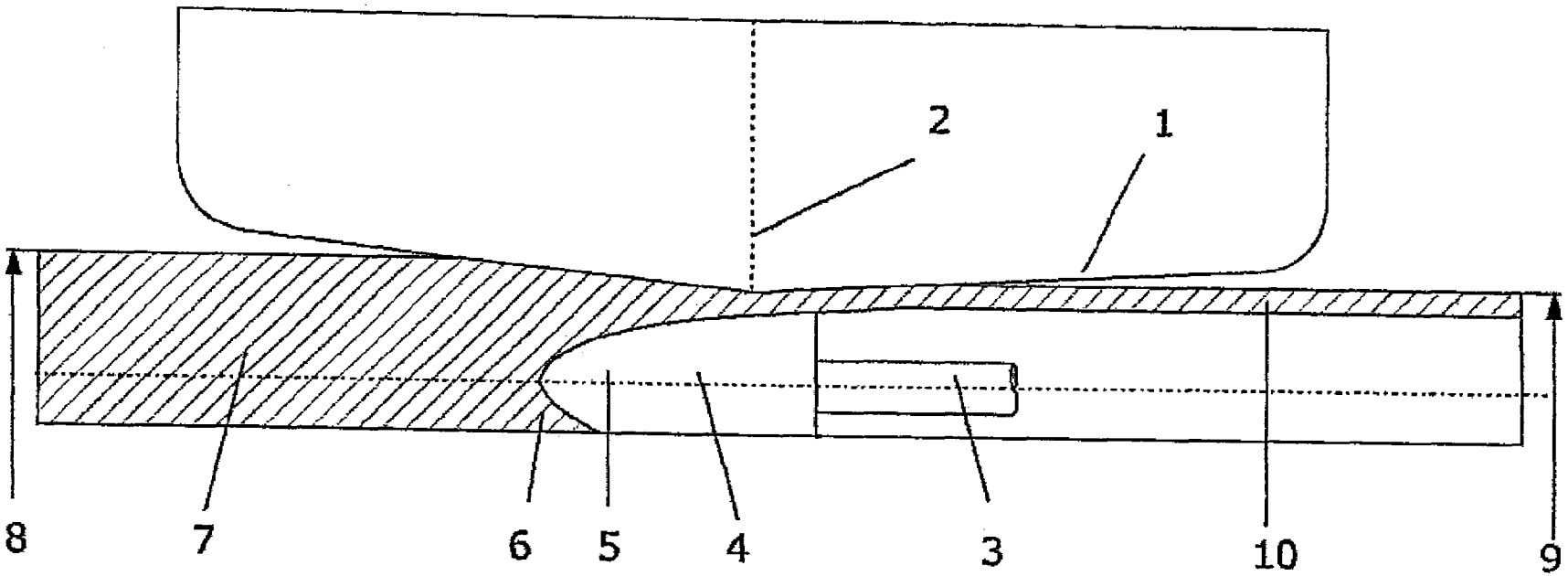
FIG. 1 shows a schematic length section of an upper half of an apparatus for making a seamless hollow body from steel in accordance with the present invention.

Clearly shown is the otherwise uncommon disposition of the piercing mandrel 3 in the first example (FIG. 1). The end of the smoothing part 4 is situated before of the 'high point' 2 and thus also the piercer 5. The mandrel tip 6 assumes hereby a position which ensures that the stated forming limit X is maintained in the run-in zone of the round block, and the round block 7 is pierced free of flaws.

Characteristic is the great diameter reduction from diameter 8 of the round block 7 to the diameter 9 of the hollow block 10.

Figure 2:
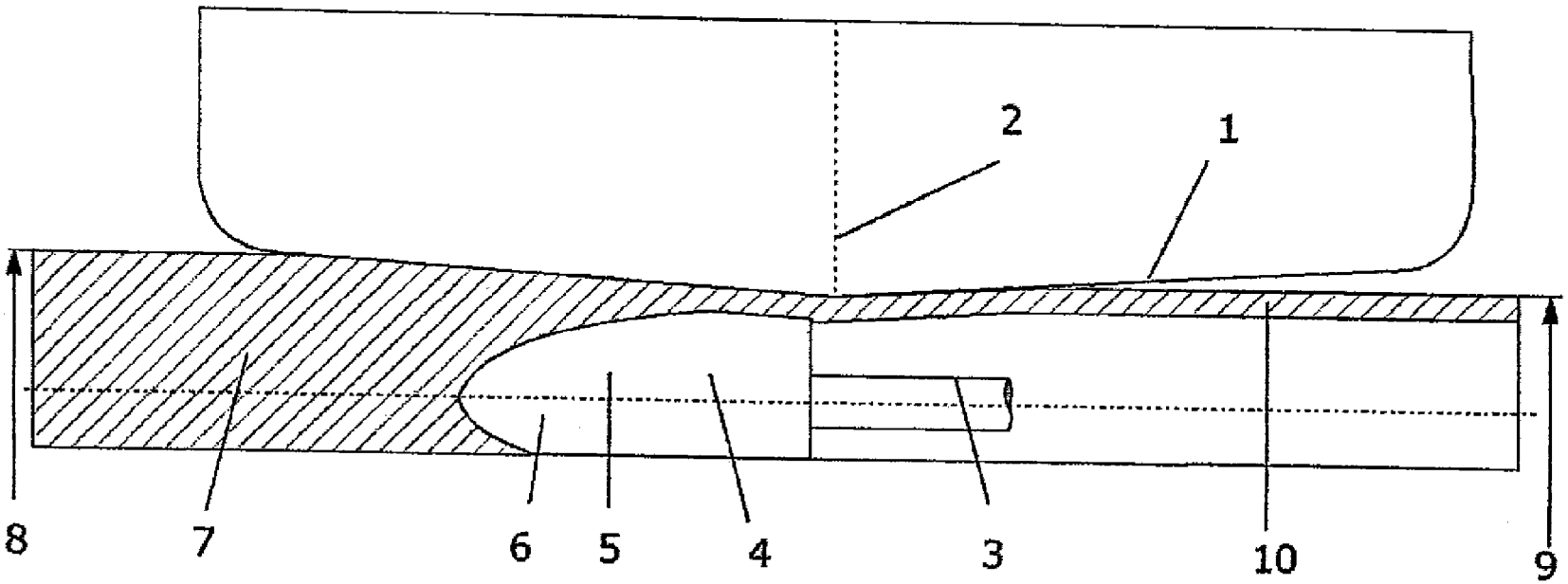
FIG. 2 shows the apparatus of FIG. 1 with a different run-in angle of a roll.
Figure 3:
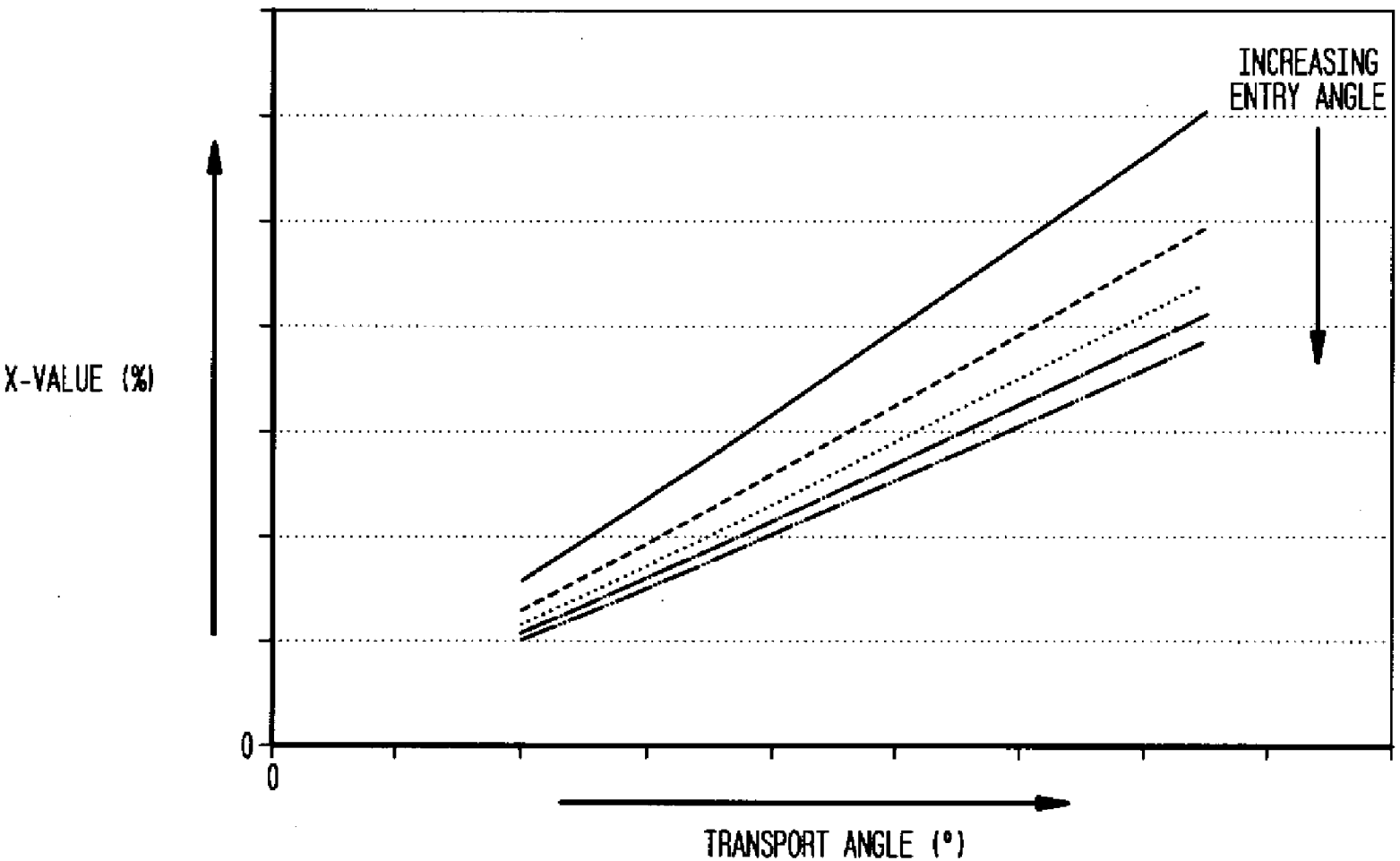
FIG. 3 is a graph showing the relation between the forming limit (X) value and the transport angle.

When the run-in angle of the roll is changed, as illustrated in the second example (FIG. 2), it can be shown that a respective hollow block with reduced diameter can be produced, when the smoothing part of the piercing mandrel is positioned behind the 'high point', while maintaining the permitted deformation before the mandrel tip. According to the illustration of (FIG. 3), the greater run-in angle causes a slightly smaller forming limit X.

Figure 4:
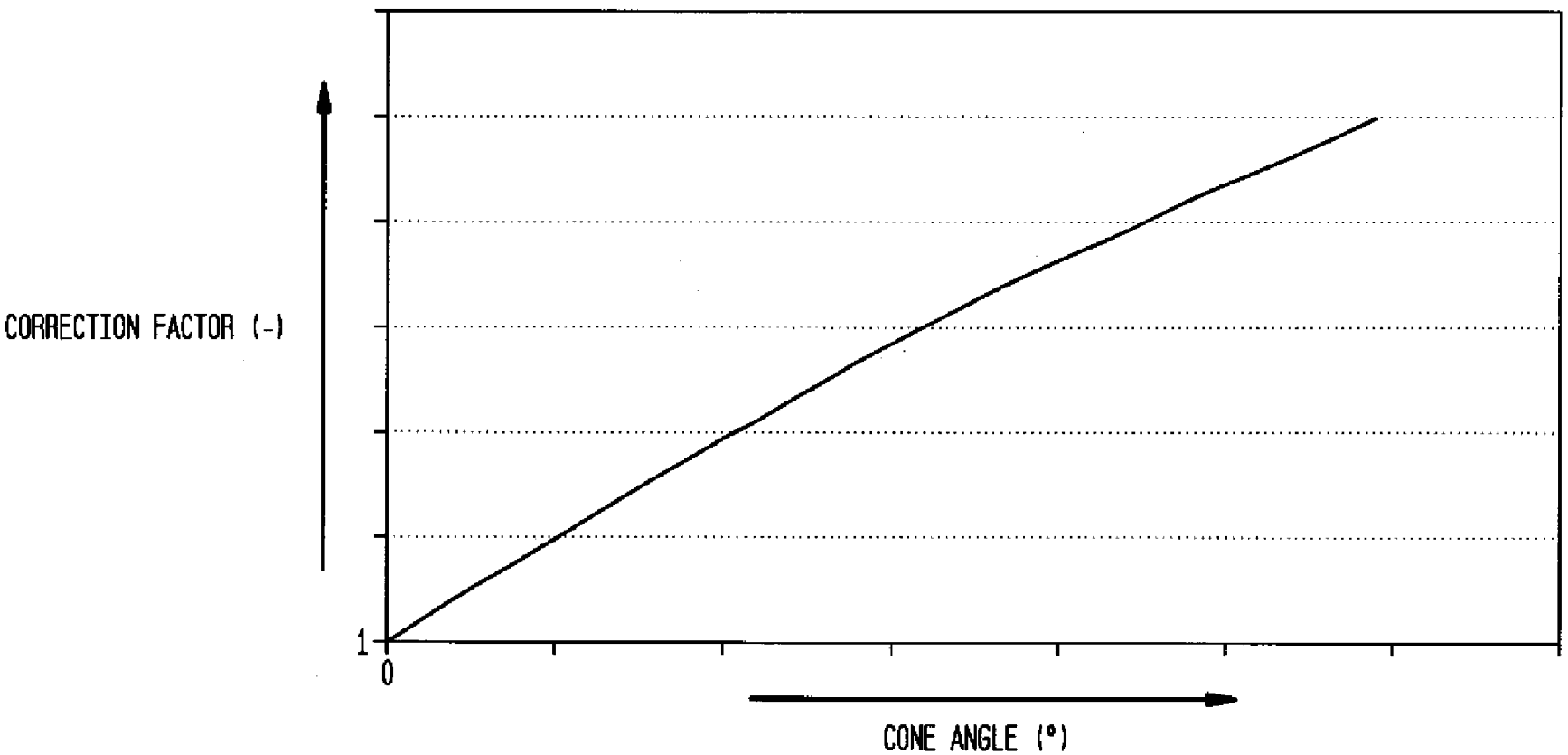
FIG. 4 is a graph showing the relation between the correction factor value and the cone angle.

FIG. 4 shows the dependency of the correction factor from the cone angle.

What is claimed is:

1. A method of making a seamless hollow body from a solid round block of steel with a diameter <95% of the solid round block diameter, by means of a two-roll cross rolling mill with a piercing mandrel held between inclined rolls and including a piercer and at least one smoothing part, while using pass-closing guides, wherein a roll spacing of the rolls in a narrowest cross section defining a high-point is adjusted in relation to the solid round block diameter, and a position of the piercing mandrel is adjusted in relation to the high-point, said method comprising the steps of:

maintaining a forming limit X for the incoming solid round block anteriorly of a tip of the piercing mandrel, with the forming limit X being dependent on a deformability of a steel material of the round block, on an adjusted transport angle, and on a run-in angle of the rolls; and determining tool distances through approximation (<3%) on the basis of the equations:

roll spacing at the high-point=diameter of the hollow block−0.075×diameter of the round block guide spacing=diameter of the hollow block+0.075×diameter of the round block wherein the forming limit X is defined as (1−ratio of a roll spacing at the piercing mandrel tip position to the diameter of the round block) in %.

2. The method of claim 1, wherein the forming limit X rises as the transport angle increases and the run-in angle decreases.

3. The method of claim 1, wherein the forming limit X lessens as the deformability decreases.

4. The method of claim 1, further comprising the step of correcting the determined forming limit X by a correction factor in dependence of a cone angle, with the cone angle being defined as an angle between rolling stock and rolling axis, when the transport angle is zero degree.

5. The method of claim 4, wherein the correction factor is equal to 1, when the cone angle is zero degree, and the correction factor is between 1 and 1.3, as the cone angle increases.

6. The method of claim 1, and further adjusting a position of the smoothing part of the piercing mandrel such that an end of the smoothing part is located at the high point, when a wall thickness of the seamless hollow body is <10% of the diameter of the hollow block as viewed in a rolling direction.

7. The method of claim 1, wherein the smoothing part of the piercing mandrel is situated in a run-in portion of the inclined rolls.

8. A method for making a seamless hollow body from solid round block of steel with a diameter <95% of the solid round block diameter, by means of a three-roll cross rolling mill with a piercing mandrel held between the inclined rolls and including a piercer and at least one smoothing part, while using pass-closing guides, wherein a roll spacing of the rolls in a narrowest cross section defining a high-point is adjusted in relation to the solid round block diameter, and a position of the piercing mandrel is adjusted in relation to the high-point, said method comprising the steps of:

maintaining a forming limit X for the incoming solid round block anteriorly of a tip of the piercing mandrel, with the forming limit X being dependent on a deformability of a steel material of the round block, on an adjusted transport angle, and on a run-in angle of the rolls; and determining tool distances through approximation (<3%) on the basis of the equation:

roll spacing at the high-point=3/2×diameter of the hollow block−½×diameter of the round block, wherein the forming limit X is defined as (1−ratio of a roll spacing at the piercing mandrel tip position to the diameter of the round block) in %.

9. The method of claim 8, wherein the forming limit X rises as the transport angle increases and the run-in angle decreases.

10. The method of claim 8, wherein the forming limit X lessens as the deformability decreases.

11. The method of claim 8, further comprising the step of correcting the determined forming limit X by a correction factor in dependence of a cone angle, with the cone angle being defined as an angle between rolling stock and rolling axis, when the transport angle is zero degree.

12. The method of claim 11, wherein the correction factor is equal to 1, when the cone angle is zero degree, and the correction factor is between 1 and 1.3, as the cone angle increases.

13. The method of claim 8, wherein the forming limit X is greater at least by a factor 1.2 in the three-roll cross rolling mill at otherwise same dependencies, compared to a two-roll cross rolling mill.

14. The method of claim 8, and further adjusting a position of the smoothing part of the piercing mandrel such that an end of the smoothing part is located at the high point, when a wall thickness of the seamless hollow body is <10% of the diameter of the hollow block as viewed in a roiling direction.

15. The method of claim 8, wherein the smoothing part of the piercing mandrel is situated in a run-in portion of the inclined rolls.

* * * * *